US005410179A

United States Patent [19]

Kornrumpf et al.

[11] Patent Number: 5,410,179

[45] Date of Patent: Apr. 25, 1995

[54] MICROWAVE COMPONENT HAVING TAILORED OPERATING CHARACTERISTICS AND METHOD OF TAILORING

[75] Inventors: William P. Kornrumpf, Albany; David A. Bates, Fayetteville, both of N.Y.

[73] Assignee: Martin Marietta Corporation, King of Prussia, Pa.

[21] Appl. No.: 504,748

[22] Filed: Apr. 5, 1990

[51] Int. Cl.[6] ..... H01V 29/02

[52] U.S. Cl. ..... 257/638; 257/730; 257/776

[58] Field of Search ..... 357/74; 257/668, 930, 257/684, 728, 698, 687, 689, 696, 700, 704, 729, 730, 758, 774, 776, 786, 48, 712, 750, 643, 638; 361/750, 729

[56] References Cited

U.S. PATENT DOCUMENTS

| | | | |
|---|---|---|---|
| 4,783,695 | 11/1988 | Eichelberger et al. | 257/668 |
| 4,878,991 | 11/1989 | Eichelberger et al. | 156/630 |
| 4,884,122 | 11/1989 | Eichelberger et al. | 257/48 |
| 4,988,412 | 1/1991 | Liu et al. | 205/118 |
| 5,019,535 | 5/1991 | Wojnarowski et al. | 257/712 |
| 5,073,814 | 12/1991 | Cole, Jr. et al. | 257/643 |
| 5,127,998 | 7/1992 | Cole, Jr. et al. | 205/135 |
| 5,200,810 | 4/1993 | Wojnarowski et al. | 361/398 |
| 5,206,712 | 4/1993 | Kornrumpf et al. | 361/393 |
| 5,331,203 | 7/1994 | Wojnarowski et al. | 257/698 |

*Primary Examiner*—John B. Sotomayor
*Attorney, Agent, or Firm*—Geoffrey H. Krauss

[57] ABSTRACT

The electrical operating characteristics of a microwave circuit are modified by providing a dielectric layer on the circuit in a pattern which modifies the electrical characteristics of an overlay responsive portion of the circuit in a manner which results in the overall circuit having a desired electrical operating characteristic within a tolerance. Adjustment of the operating characteristics may be done in an iterative manner of measuring the characteristics, modifying the distribution of dielectric material and remeasuring the operating characteristics until satisfactory operating characteristics are obtained. Alternatively, the operating characteristics may be adjusted in an interactive manner in which the circuit is provided with power and appropriate signals and its operating characteristics are monitored during the process of selectively removing dielectric material with the removal process being controlled in accordance with the current electrical operating characteristics and being terminated when a desired set of operating characteristics is obtained.

82 Claims, 10 Drawing Sheets

MICROWAVE COMPONENT HAVING TAILORED OPERATING CHARACTERISTICS AND METHOD OF TAILORING

RELATED APPLICATIONS

The present invention is related to application Ser. No. 07/504,760, now U.S. Pat. No. 5,206,712, issued Apr. 27, 1993, entitled, "A Building Block Approach to Microwave Modules" by W. P. Kornrumpf, et al., application Ser. No. 07/504,821, now U.S. Pat. No. 5,355,102, issued Oct. 11, 1994, entitled, "High Density Interconnected Microwave Circuit Assembly" by W. P. Kornrumpf, et al. and application Ser. No. 07/504,803, now U.S. Pat. No. 5,351,000, issued Sep. 27, 1994, entitled, "Microwave Component Test Method and Apparatus", by W. P. Kornrumpf, et al., each of which is being filed concurrently herewith and each of which is incorporated herein by reference in its entirety.

BACKGROUND OF THE INVENTION

1. Field of the Invention

The present invention relates to the field of microwave components and more particularly to the field of microwave chip components.

2. Background Information

A major problem in the field of semiconductor microwave components is component testing. The results of component testing have a poor correlation with respect to the operation of the tested components in an actual system. This low correlation is a result, in part, of difficulties in obtaining high quality, repeatable connections between a test system and a microwave component which is not bonded to the test system. Temporary bonding of a component to a test system for testing purposes is not feasible because such bonds can not be reworked and thus, the tested component can not be used in a system after testing.

Another problem is the low yield of components which actually meet specifications. A number of factors contribute to this low yield. One of the major contributors is the small size of microwave devices embodied in semiconductor chips and the effects that small variations in the structure of those devices have on the electrical operating characteristics of those components.

The monolithic microwave integrated circuit (MMIC) which is normally fabricated in gallium arsenide contains a plurality of devices which together provide an overall transfer function or other electrical operating characteristics which are useful in microwave systems. Because of fabrication tolerances and other effects, the yield of MMICs is relatively small. In many cases, MMICs are operational but do not meet the fairly tight specifications on their operating characteristics which are required in order for systems assembled from those MMICs to operate within their own specifications. This is a separate problem from the problem of an inability to accurately measure the operating characteristics of such components prior to their assembly into final systems.

Another problem with microwave components in general is the great sensitivity of their operating characteristics to the environment in which they are disposed. The operation of such devices, especially GaAs devices and components are extremely sensitive to the presence of a high dielectric constant material on or directly adjacent to their surface. This sensitivity is so great, that a number of microwave device producers refuse to allow any dielectric material whatsoever (not even a passivating layer of glass) to be disposed on the surface of a GaAs device.

The related application Ser. No. 07/504,803 provides a solution to the problem of testing microwave components when those components are to be assembled into systems in accordance with related application Ser. No. 07/504,821 or packaged in accordance with application Ser. No. 07/504,760. These related applications solve the problem of testing microwave components and assembling them into systems with reasonable yields through a process of selecting components which, in fact, have desired operating characteristics or have operating characteristics which can be brought within specifications by modifying the conductors of a high density interconnect structure with which those devices are packaged. This compensates for device characteristic deviations from specifications as measured during testing. Unfortunately, such techniques cannot salvage operative microwave components whose characteristics are too far outside specifications. Further, such techniques can be cumbersome and are dependent on the inclusion in the package of modifiable high density interconnect structures. There is a need for a means of salvaging microwave components which are operative but do not meet their specifications.

A high density interconnect (HDI) structure or system which has been developed by General Electric Company offers many advantages in the compact assembly of electronic systems. For example, an electronic system such as a micro computer which incorporates 30–50 chips can be fully assembled and interconnected on a single substrate which is 2 inch long by 2 inch wide by 0.050 inch thick. Even more important, this interconnect structure can be disassembled for repair or replacement of a faulty component and then reassembled without significant risk to the good components incorporated within the system. This is particularly important where as many as 50 chips having a cost of as much as $2,000.00, each, may be incorporated in a single system on one substrate. This repairability is a substantial advance over prior connection systems in which reworking the system to replace damaged components was either impossible or involved substantial risk to the good components.

Briefly, in this high density interconnect structure, a ceramic substrate such as alumina which may be 25–100 mils thick and of appropriate size and strength for the overall system, is provided. This size is typically less than 2 inches square. Once the position of the various chips has been specified, individual cavities or one large cavity having appropriate depth at the intended locations of differing chips, is prepared. This may be done by starting with a bare substrate having a uniform thickness and the desired size. Conventional, ultrasonic or laser milling may be used to form the cavities in which the various chips and other components will be positioned. For many systems where it is desired to place chips edge-to-edge, a single large cavity is satisfactory. That large cavity may typically have a uniform depth where the semiconductor chips have a substantially uniform thickness. Where a particularly thick or a particularly thin component will be placed, the cavity bottom may be made respectively deeper or shallower to place the upper surface of the corresponding component in substantially the same plane as the upper surface of the rest of the components and the portion of the substrate which surrounds the cavity. The bottom of the cavity is then provided with a thermoplastic adhesive layer which may preferably be polyetherimide resin available under the trade name ULTEM® from the General Electric Company. The various components are then placed in their desired locations within the cavity, the entire structure is heated to the softening point of the ULTEM® polyetherimide (in the vicinity of 217° C. to 235° C. depending on the formulation used) and then cooled to thermoplastically bond the individual components to the substrate. Thereafter, a polyimide film which may be Kapton® polyimide, available from E.I. du Pont de Nemours Company, which is ≈0.0005–0.003 inch (≈12.5–75 microns) thick is pretreated to promote adhesion and coated on one side with the ULTEM® polyetherimide resin or another thermoplastic and laminated across the top of the chips, any other components and the substrate with the ULTEM® resin serving as a thermoplastic adhesive to hold the Kapton® in place. Thereafter, via holes are laser drilled in the Kapton® and ULTEM® layers in alignment with the contact pads on the electronic components to which it is desired to make contact. A metallization layer which is deposited over the Kapton® layer extends into the via holes and makes electrical contact to the contact pads disposed thereunder. This metallization layer may be patterned to form individual conductors during the process of depositing it or may be deposited as a continuous layer and then patterned using photoresist and etching. The photoresist is preferably exposed using a laser to provide an accurately aligned conductor pattern at the end of the process.

Additional dielectric and metallization layers are provided as required in order to provide all of the desired electrical connections among the chips. Any misposition of the individual electronic components and their contact pads is compensated for by an adaptive laser lithography system which is the subject of some of the Patents and Applications which are listed hereinafter.

In this manner, the entire interconnect structure can be fabricated from start to finish (after definition of the required conductor patterns and receipt of the electronic components) in as little as ≈8–12 hours.

This high density interconnect structure provides many advantages. Included among these are the the lightest weight and smallest volume packaging of such an electronic system presently available. A further, and possibly more significant advantage of this high density interconnect structure, is the short time required to design and fabricate a system using this high density interconnect structure. Prior art processes typically require the prepackaging or flip-chip mounting of each semiconductor chip, the design of a multilayer circuit board to interconnect the various packaged chips, and so forth. Multilayer circuit boards are expensive and require substantial lead time for their fabrication. In contrast, the only thing which must be specially prefabricated for the HDI system is the substrate on which the individual semiconductor chips will be mounted. This substrate is a standard stock item, other than the requirement that the substrate have appropriate cavities therein for the placement of the semiconductor chips so that the interconnect surface of the various chips and the substrate will be in a single plane. In the HDI process, the required cavities may be formed in an already fired ceramic substrate by conventional, ultrasonic or laser milling. Other compatible substrate materials may also be used. This milling process is straightforward and fairly rapid with the result that once a desired configuration for the substrate has been established, a corresponding physical substrate can be made ready for the mounting of the semiconductor chips in as little as 1 day and typically 4 hours for small quantities as are suitable for research or prototype systems to confirm the design prior to quantity production.

The process of designing an interconnection pattern for interconnecting all of the chips and components of an electronic system on a single high density interconnect substrate normally takes somewhere between one week and five weeks. Once that interconnect structure has been defined, assembly of the system on the substrate may begin. First, the chips are mounted on the substrate and the overlay structure is built-up on top of the chips and substrate, one layer at a time. Typically, the entire process can be finished in one day and in the event of a high priority rush, could be completed in four hours. Consequently, this high density interconnect structure not only results in a substantially lighter weight and more compact package for an electronic system, but enables a prototype of the system to be fabricated and tested in a much shorter time than is required with other packaging techniques.

This high density interconnect structure, methods of fabricating it and tools for fabricating it are disclosed in U.S. Pat. No. 4,783,695, entitled "Multichip Integrated Circuit Packaging Configuration and Method" by C. W. Eichelberger, et al.; U.S. Pat. No. 4,835,704, entitled "Adaptive Lithography System to Provide High Density Interconnect" by C. W. Eichelberger, et al.; U.S. Pat. No. 4,714,516, entitled "Method to Produce Via Holes in Polymer Dielectrics for Multiple Electronic Circuit Chip Packaging" by C. W. Eichelberger, et al.; U.S. Pat. No. 4,780,177, entitled "Excimer Laser Patterning of a Novel Resist" by R. J. Wojnarowski et al.; U.S. patent application Ser. No. 249,927, filed Sep. 27, 1989, now U.S. Pat. No. 5,154,793, issued Oct. 13, 1992, entitled "Method and Apparatus for Removing Components Bonded to a Substrate" by R. J. Wojnarowski, et al.; U.S. patent application Ser. No. 310,149, filed Feb. 14, 1989, now U.S. Pat. No. 4,894,115, issued Jan. 16, 1990, entitled "Laser Beam Scanning Method for Forming Via Holes in Polymer Materials" by C. W. Eichelberger, et al.; U.S. patent application Ser. No. 312,798, now abandoned, filed Feb. 21, 1989, entitled "High Density Interconnect Thermoplastic Die Attach Material and Solvent Die Attachment Processing" by R. J. Wojnarowski, et al.; U.S. patent application Ser. No. 283,095, filed Dec. 12, 1988, now U.S. Pat. No. 4,878,991, issued Nov. 7, 1989, entitled "Simplified Method for Repair of High Density Interconnect Circuits" by C. W. Eichelberger, et al.; U.S. patent application Ser. No. 305,314, filed Feb. 3, 1989, now abandoned, entitled "Fabrication Process and Integrated Circuit Test Structure" by H. S. Cole, et al.; U.S. patent application Ser. No. 250,010, filed Sep. 27, 1988, now U.S. Pat. No. 5,019,535, issued May 28, 1991, entitled "High Density Interconnect With High Volumetric Efficiency" by C. W. Eichelberger, et al.; U.S. patent application Ser. No. 329,478, filed Mar. 28, 1989, now U.S. Pat. No. 5,019,535, issued May 28, 1991, entitled "Die Attachment Method for Use in High Density Interconnected Assemblies" by R. J. Wojnarowski, et al.; U.S. patent application Ser. No. 253,020, filed Oct. 4, 1988, now U.S. Pat. No. 4,960,613, issued Oct. 2, 1990, entitled "Laser Interconnect Process" by H. S.

Cole, et al.; U.S. patent application Ser. No. 230,654, filed Aug. 5, 1988, now U.S. Pat. No. 4,884,122, issued Nov. 28, 1989, entitled "Method and Configuration for Testing Electronic Circuits and Integrated Circuit Chips Using a Removable Overlay Layer" by C. W. Eichelberger, et al.; U.S. patent application Ser. No. 233,965, filed Aug. 8, 1988, now abandoned, entitled "Direct Deposition of Metal Patterns for Use in Integrated Circuit Devices" by Y. S. Liu, et al.; U.S. patent application Ser. No. 237,638, filed Aug. 23, 1988, now U.S. Pat. No. 4,882,200, issued Nov. 21, 1989, entitled "Method for Photopatterning Metallization Via UV Laser Ablation of the Activator" by Y. S. Liu, et al.; U.S. patent application Ser. No. 237,685, filed Aug. 25, 1988, now abandoned, entitled "Direct Writing of Refractory Metal Lines for Use in Integrated Circuit Devices" by Y. S. Liu, et al.; U.S. patent application Ser. No. 240,367, filed Aug. 30, 1988, now U.S. Pat. No. 4,933,042, issued Jun. 12, 1990, entitled "Method and Apparatus for Packaging Integrated Circuit Chips Employing a Polymer Film Overlay Layer" by C. W. Eichelberger, et al.; U.S. patent application Ser. No. 342,153, filed Apr. 24, 1989, now U.S. Pat. No. 4,899,153, issued Jan. 30, 1990, entitled "Method of Processing Siloxane-Polyimides for Electronic Packaging Applications" by H. S. Cole, et al.; U.S. patent application Ser. No. 289,944, filed Dec. 27, 1988, now U.S. Pat. No. 4,988,412, issued Jan. 29, 1991, entitled "Selective Electrolytic Deposition on Conductive and Non-Conductive Substrates" by Y. S. Liu, et al.; U.S. patent application Ser. No. 312,536, filed Feb. 17, 1989, now abandoned, entitled "Method of Bonding a Thermoset Film to a Thermoplastic Material to Form a Bondable Laminate" by R. J. Wojnarowski; U.S. patent application Ser. No. 363,646, filed Jun. 8, 1989, now abandoned, entitled "Integrated Circuit Packaging Configuration for Rapid Customized Design and Unique Test Capability" by C. W. Eichelberger, et al.; U.S. patent application Ser. No. 07/459,844, filed Jan. 2, 1990, now U.S. Pat. No. 5,127,998, issued Jul. 7, 1992, entitled "Area-Selective Metallization Process" by H. S. Cole, et al.; U.S. patent application Ser. No. 07/457,023, filed Dec. 26, 1989, now U.S. Pat. No. 5,258,920, issued Nov. 2, 1993, entitled "Locally Orientation Specific Routing System" by T. R. Haller, et al.; U.S. patent application Ser. No. 456,421, filed Dec. 26, 1989, now U.S. Pat. No. 5,169,678, issued Dec. 8, 1992, entitled "Laser Ablatable Polymer Dielectrics and Methods" by H. S. Cole, et al.; U.S. patent application Ser. No. 454,546, filed Dec. 21, 1989, now abandoned, entitled "Hermetic High Density Interconnected Electronic System" by W. P. Kornrumpf, et al.; U.S. patent application Ser. No. 07/457,127, filed Dec. 26, 1989, now U.S. Pat. No. 5,040,047, issued Aug. 13, 1991, entitled "Enhanced Fluorescence Polymers and Interconnect Structures Using Them" by H. S. Cole, et al.; and U.S. patent application Ser. No. 454,545, filed Dec. 21, 1989, now abandoned, entitled "An Epoxy/Polyimide Copolymer Blend Dielectric and Layered Circuits Incorporating It" by C. W. Eichelberger, et al. Each of these Patents and Patent Applications is incorporated herein by reference.

OBJECTS OF THE INVENTION

Accordingly, a primary object of the present invention is to provide a technique for adjusting the operating characteristics of a microwave component to bring them into specification.

Another object of the present invention is to provide microwave components whose operating characteristics are adjusted to a desired status within a tight tolerance.

Another object of the present invention is to provide a means of trimming the operating characteristics of a microwave component during testing.

A further object of the present invention is to provide a microwave component having an overlay-responsive operating characteristic in which the presence and characteristics of an overlay on the component serve to adjust the component's operating characteristics.

SUMMARY OF THE INVENTION

The above and other objects which will become apparent from the specification as a whole, including the drawings, are achieved in accordance with the present invention by providing a dielectric layer on the surface of a microwave component and tailoring the configuration of that dielectric material to bring the electrical operating characteristics of that component to within a tolerance of a desired specification.

In accordance with a further embodiment, a conductive material is disposed on the dielectric material and configured to further adjust the electrical operating characteristics of the component.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION

Figure 1:
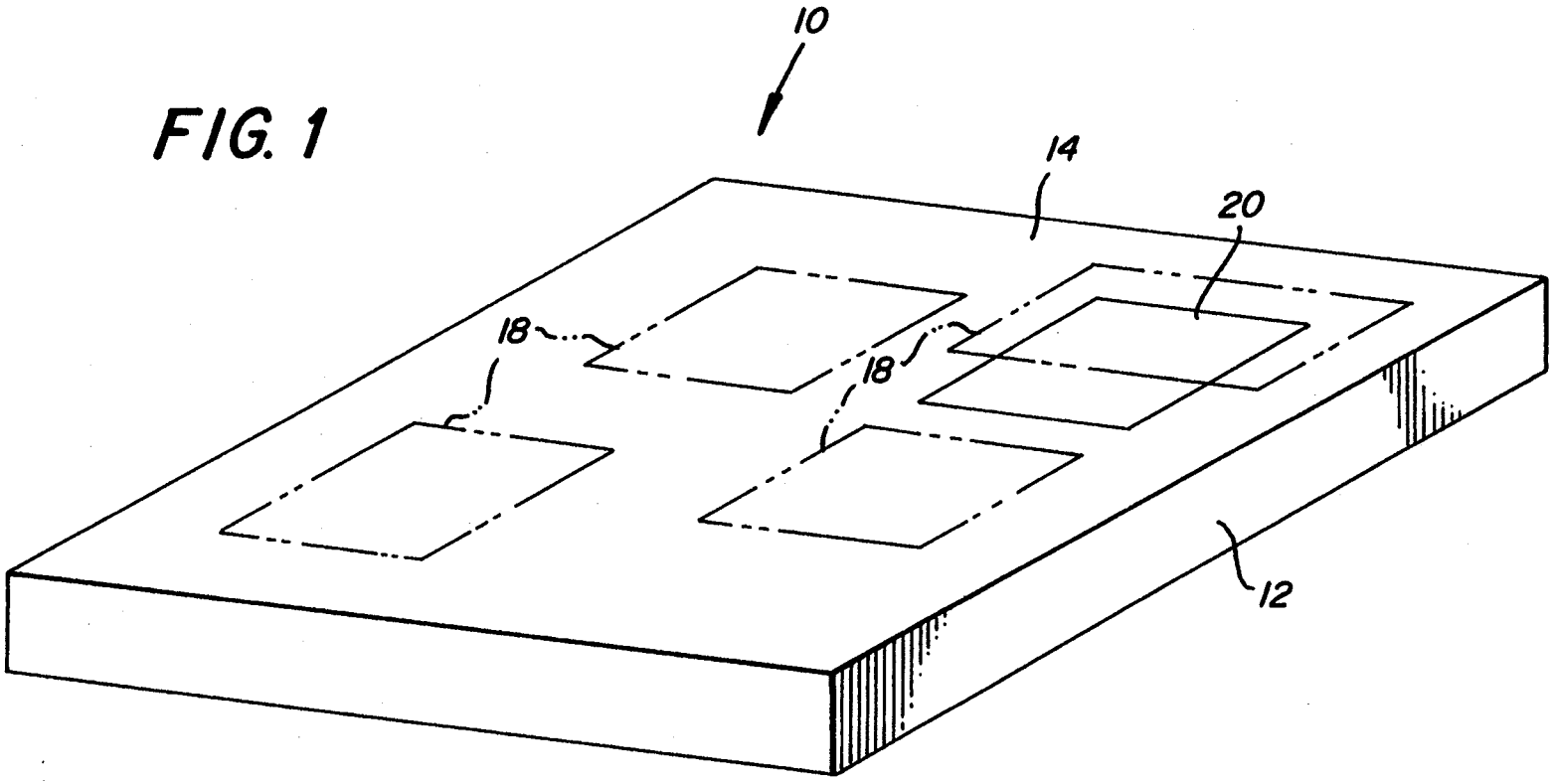
FIG. 1 is a perspective schematic illustration of a portion of a microwave circuit.

In FIG. 1, a portion 10 of a microwave circuit is illustrated in a schematic perspective view. The circuit 10 includes a substrate, body, or semiconductor chip 12 including at least one microwave component or device 20 therein or thereon. The device 20 is illustrated as an empty rectangle in view of the vast variety of different microwave components or devices which may comprise the element 20 in this structure. Also present in the body 12 are four overlay-sensitive portions 18 of the upper surface 14 of the body 12. The regions 18 are portions of the surface 14 whose dielectric and conductive characteristics affect the operation of the portion 10 of the microwave circuit. In particular, the presence of a material in one of these regions having a relative dielectric constant greater than 1 modifies the operating characteristics of the circuit 10 as compared to those operating characteristics in the absence of such material. It should be recognized that as illustrated in FIG. 1, an overlay sensitive portion of a circuit or chip 12 may be displaced from an active device and still be associated with it in the sense that the presence of dielectric material in that location alters the operating characteristics of the active component because of an interaction of that dielectric with electromagnetic fields associated with the active component. On the other hand, the overlay-sensitive portion may be sufficiently displaced from an active device that any interaction between the active device and the overlay sensitive portion is a result of circuit effects, such as the tuning of a tuned circuit or filter rather than by direct interaction between the overlay layer and electromagnetic fields associated with the operation of the component. Further, the overlay sensitive portion of the structure may not even be part of a semiconductor chip, but may be a separately fabricated component or structure.

Typically, such overlay sensitive portions 18 exhibit a further change in the operating characteristics of the circuit 10 if a conductive layer is disposed on top of a dielectric layer disposed such a region. The regions 18 may be associated with devices or components which may be embedded in the body 12 or which may be disposed at or on the upper surface 14 of the body 12 (but which are not shown in FIG. 1). The overlay sensitive portions 18 may comprise any of a vast variety of specific microwave components. These components may include passive components such as electrodes, conductors, capacitors, inductors, resistors, transmission lines, interdigitated (Lange) couplers, filters, combiners, dividers, transformers and so forth. They may also comprise active devices such as diodes, transistors, particularly the gate region of insulated gate field effect transistors, amplifiers, active attenuators and so forth, including more complex subsystems which include a plurality of less complex passive and active components.

The body 12 may comprise a semiconductor chip and the circuit 10 may comprise a monolithic microwave integrated circuit (MMIC) or other microwave circuit or subsystem. In such systems, it is normal practice in the microwave art to avoid providing additional layers on the body 12 in the vicinity of the overlay-sensitive portions 18 in order to avoid interfering with the proper operation of the circuit 10.

In accordance with the present invention, a dielectric layer, a conductive layer or a combination of a dielectric layer and a conductive layer are disposed on one or more overlay-sensitive portions of the surface 14 of the body 12. We refer to overlay-sensitive portions hereinafter as overlay-responsive portions because our invention converts these overlay-sensitive portions which are a problem in the prior art, into a means for adjusting the operating characteristic of the component in a desired manner.

An overlay control structure in accordance with this invention is either formed in a predetermined pattern which modifies the operating characteristics of the circuit 10 in a desired manner or is applied in an unpatterned or less patterned manner and subsequently configured or patterned to modify the operating characteristics of the circuit 10 in a desired manner. This may be done in a variety of ways.

In accordance with a first alternative, the operating characteristics of the circuit 10 are determined by testing prior to the deposition of any additional dielectric or conductive layers thereon. From those operating characteristics a pattern of dielectric material, conductive material or a combination of dielectric and conductive material is determined which will result in the circuit 10 having a desired set of operating characteristics.

This determination of a particular overlay pattern may be done in accordance with any of a variety of techniques. A table look-up system may be used in which measured operating characteristics are associated with overlay control structures which produce a desired set of final operating characteristics. It may be done by comparing the measured operating characteristics with a desired set of operating characteristics and determining from the results of that comparison a pattern for an overlay control structure which will produce the desired operating characteristics. This pattern is then formed on the chip or component.

Figure 2:
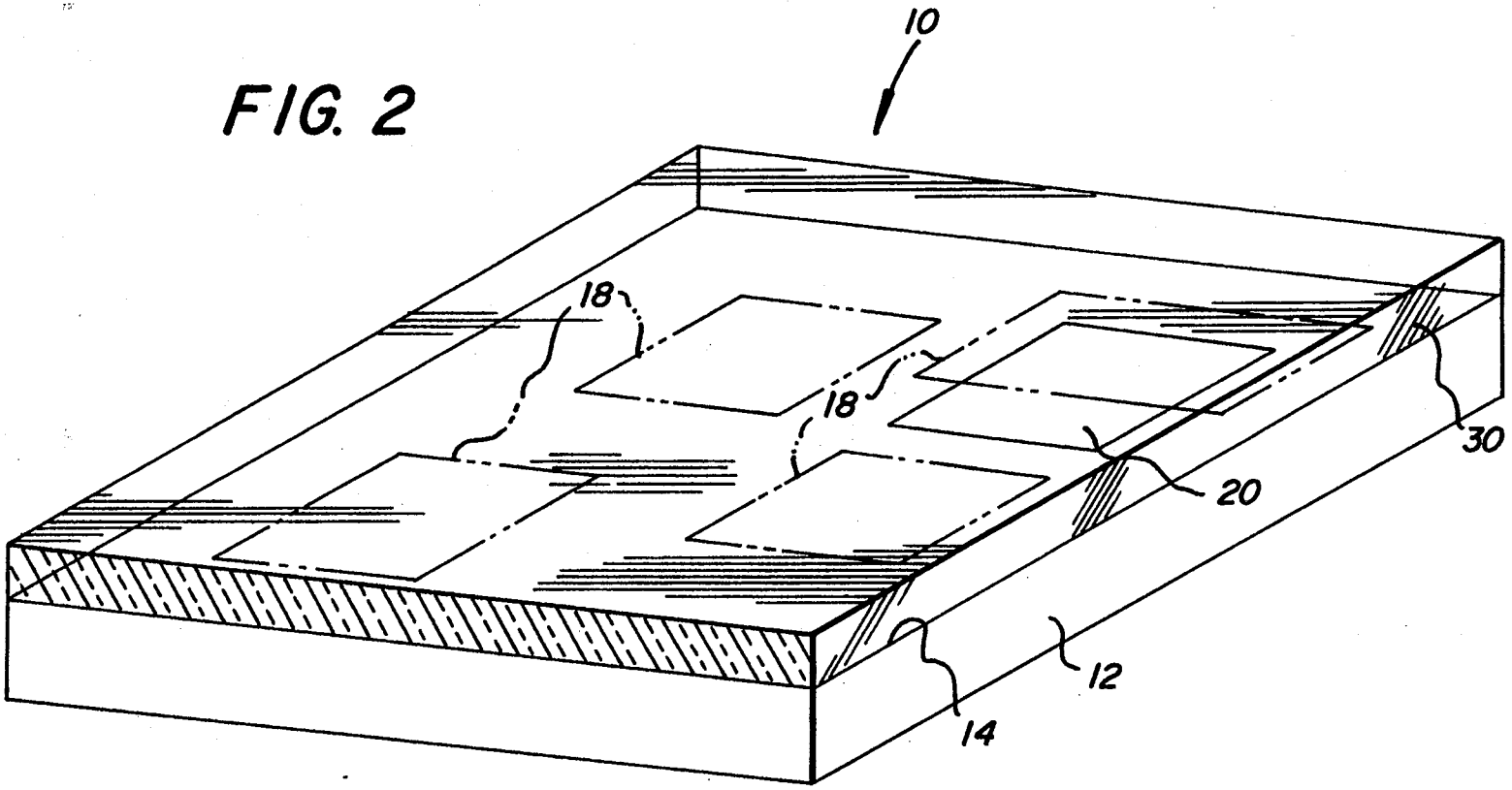
FIGS. 2–10 are perspective schematic illustrations of portions of microwave circuits in accordance with the present invention.

Alternatively, a dielectric layer 30 as illustrated in FIG. 2 may be disposed on the upper surface 14 of the body 12 prior to measuring the operating characteristics of the circuit 10. Following measurement of the operating characteristics of the circuit with the dielectric layer 30 disposed thereon a pattern in which the dielectric material should be removed in order to provide the circuit 10 with its desired operating characteristics may be determined by appropriate methods such as table look-up, by direct comparison of actual and desired operating characteristics, by systematic (or trial and error) removal of dielectric material interleaved with retesting the component to determine its current operating characteristics until a desired set of operating characteristics is obtained.

The selective removal of the dielectric layer 30 is preferably done by laser ablation using a laser which emits in the ultraviolet portion of the electromagnetic spectrum at a frequency which is effective for ablating the particular dielectric material used. The dielectric layer 30 may preferably comprise a layer of thermoset polyimide available under the trade name KAPTON TM which is bonded to the upper surface 14 of the body 12 by a thermoplastic adhesive which may be a polyetherimide resin available from General Electric Company under the trade name ULTEM TM where a relatively high lamination temperature of 217° to 240° C. is desirable or acceptable and may involve the use of a lower temperature thermoplastic dielectric material such as a polyester where it is desired to keep the processing temperature under 150° C. Where a polyester is used as the thermoplastic adhesive, we prefer to include laser ablation enhancing dyes in the polyester in accordance with U.S. patent application Ser. No. 07/456,421, entitled "Laser Ablatable Polymer Dielectrics and Methods" by H. S. Cole et al., in order that the adhesive layer and the KAPTON layer may both be ablatable by a laser operating at 351 nm. That application is incorporated herein by reference.

Figure 3:
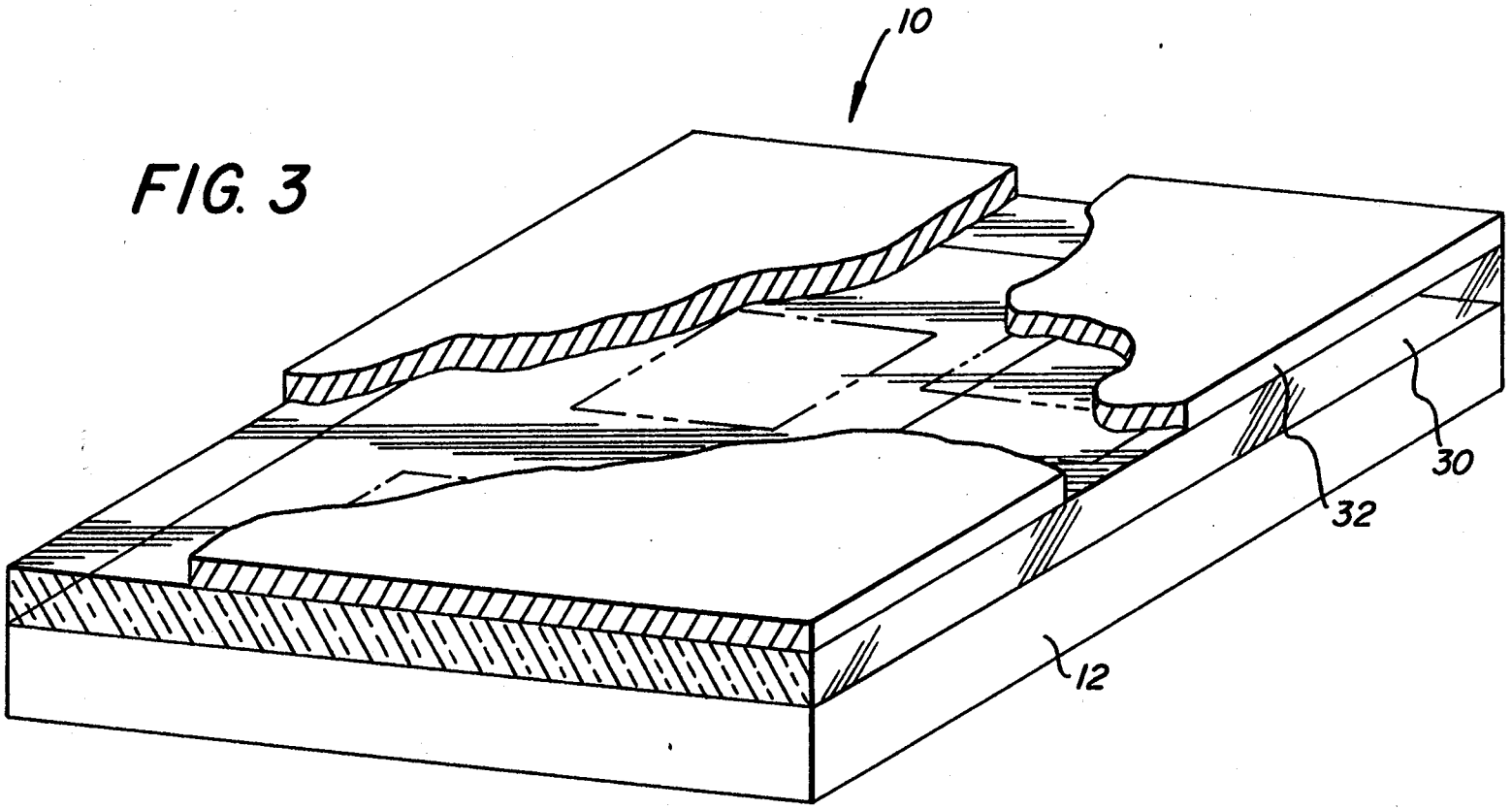

As a further alternative, rather than a pattern of removal of the dielectric layer 30 being determined, a pattern for selective deposition of a metal layer 32 on top of the dielectric layer 30 as illustrated in FIG. 3 may be determined. Such selective deposition may be done by laser induced deposition of metals from metal organic compounds either to directly form the desired conductive layer or to form a catalyst which results in deposition of the desired metal layer as a result of insertion of the component 10 in an appropriate electrodeless metal plating bath. As a further alternative, a uniform metal layer 32 may be deposited on the dielectric layer 30 and that metal layer selectively removed to leave metal in only the desired locations.

Where uniform metal layer is deposited, that layer may preferably be selectively removed by applying a photoresist thereover and patterning the photoresist with a laser through the use of an appropriate mask or by appropriately scanning a small spot size laser beam. Subsequently, development of the photoresist and etching of the metal layer produces the desired retained metallization pattern on the body 12.

An active, real time, continuous or interactive trimming, shaping, or removing process may be used for the shaping or removing of the dielectric layer. In this process, the circuit 10 is connected to an appropriate power and signal sources and its operating characteristics are actively monitored while a laser selectively ablates the dielectric material of the layer 30. Such laser ablation is normally done in accordance with known effects of the presence of the dielectric material and in a manner which experience shows will modify the operating characteristics of the circuit in a manner which provides maximum stability after the completion of the adjustment while providing reasonable sensitivity of the operating characteristics to the rate of material removal in the sense that the operating characteristics do not change suddenly in response to removal of a very small quantity of material.

In accordance with the particular removal technique used, it may be desirable to stop the selective removal process before the desired operating characteristics are obtained. A laser ablation process of the type described in the background patents and applications may be used in which the dielectric material is laser ablated to remove the bulk of the material and the laser ablation is subsequently followed by a plasma etch using a combination of $CF_4$ and $O_2$ to remove any thin residual portion of the ablated layer or any debris which may remain on the body 12 at the end of the laser ablation process. Such subsequent plasma etching may make it desirable to stop the selective removal process before the desired characteristics are obtained in order that the subsequent change in dielectric pattern as a result of the plasma etching step will not result in overcorrecting the actual operating characteristics to beyond the desired operating characteristics.

Following the completion of this interactive removal process and any subsequent cleanup steps such as plasma etching, the circuit 10 may preferably be retested to insure that the desired operating characteristics have actually been obtained. In the event of overcorrection there are a number of techniques which may be used to bring the operating characteristics back to the desired condition. These include selective addition of a metal layer on top of the dielectric layer where that has an effect of modifying the characteristics of the circuit in the same direction as replacing dielectric material would. Another alternative is to apply more dielectric material and repeat the selective removal process. A third alternative where the circuit 10 includes a plurality of overlay responsive portions is to selectively remove dielectric material from a different overlay responsive portion in which removal effects the operating characteristics in the opposite direction from that in which removal in the initial overlay responsive portion affects the operating characteristics. For example, where two different overlay responsive portions each comprise a capacitance and where proper circuit operation results from a desired balance between the capacitances, excessive removal of dielectric material on the first overlay-responsive portion has the effect of making the circuit operate as though there was excessive dielectric material present on the second overlay-responsive portion. Consequently, removal of dielectric material from that second overlay-responsive portion modifies the operating characteristics back toward the desired condition. A fourth alternative is that removal of dielectric material from a different part of a single overlay-responsive portion of the component has an opposite effect on the operating characteristics. In that case, the counteracting removal may be done from the same overlay-responsive portion of the component rather than from a different overlay-responsive portion.

Figure 4:
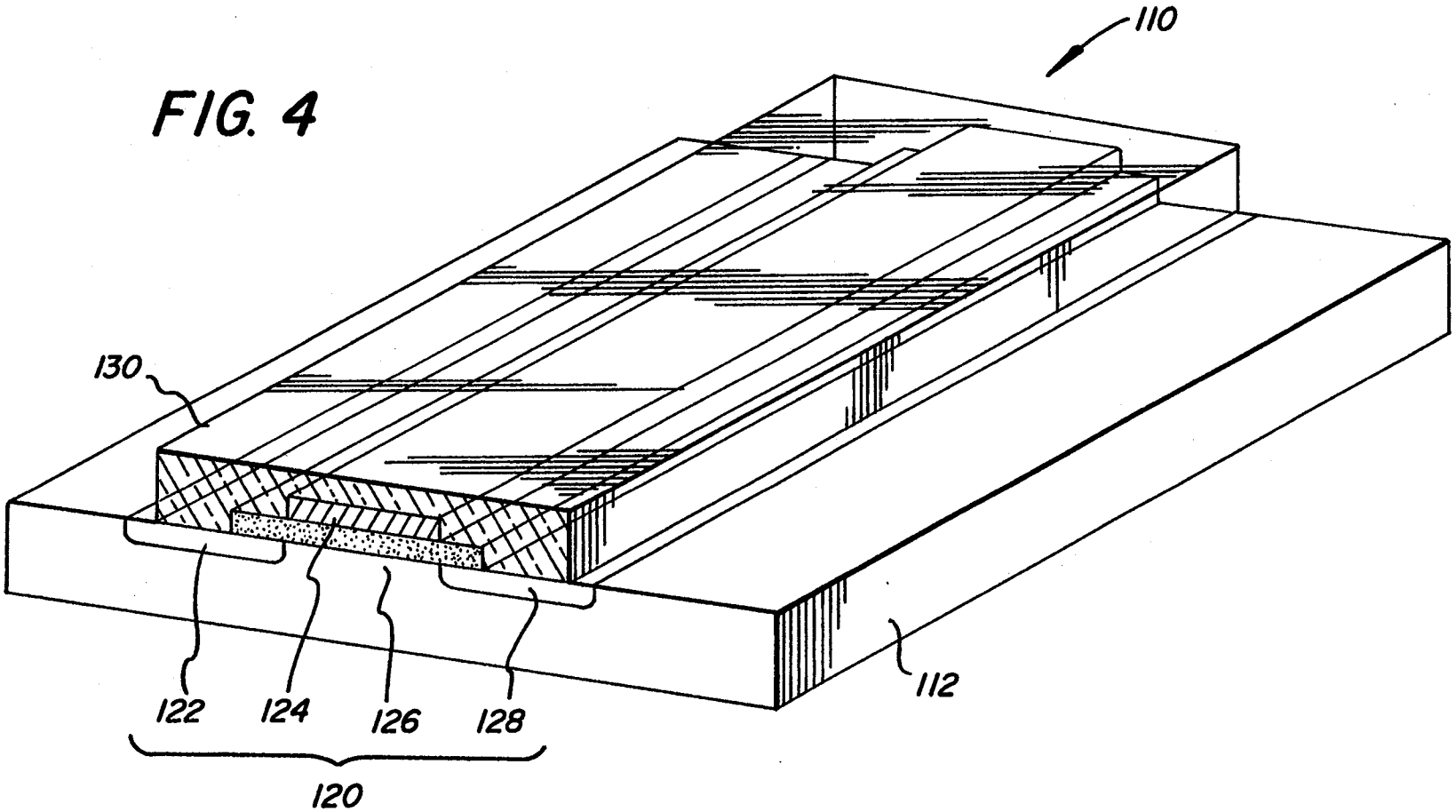

A variety of different structures may comprise overlay responsive portions of a circuit 10. FIG. 4 illustrates a circuit 110 in which an overlay responsive portion comprises a field effect transistor 120 having a source region 122, a drain region 128, a gate electrode 124 and a channel region 126. Provision of a polymer dielectric layer 130 on top of this field effect transistor has the effect of increasing the loading on this transistor thereby decreasing its gain at microwave frequencies and its cutoff frequency. Gain reductions of 1 to 2 dB have been obtained. Following the provision of the dielectric layer 130, dielectric layer 130 may be selectively removed by laser ablation until the circuit 110 has the desired operating characteristics. However, this in not a preferred structure to use for modifying the operating characteristics of a MMIC or other component because the FETs are typically the most delicate component in the circuit and a dielectric overlay changes several device characteristics simultaneously and degrades the performance of the FET. Thus, where feasible, it is considered preferable to modify the characteristics of other portions of the circuit to adjust the circuit's operation.

Figure 5:
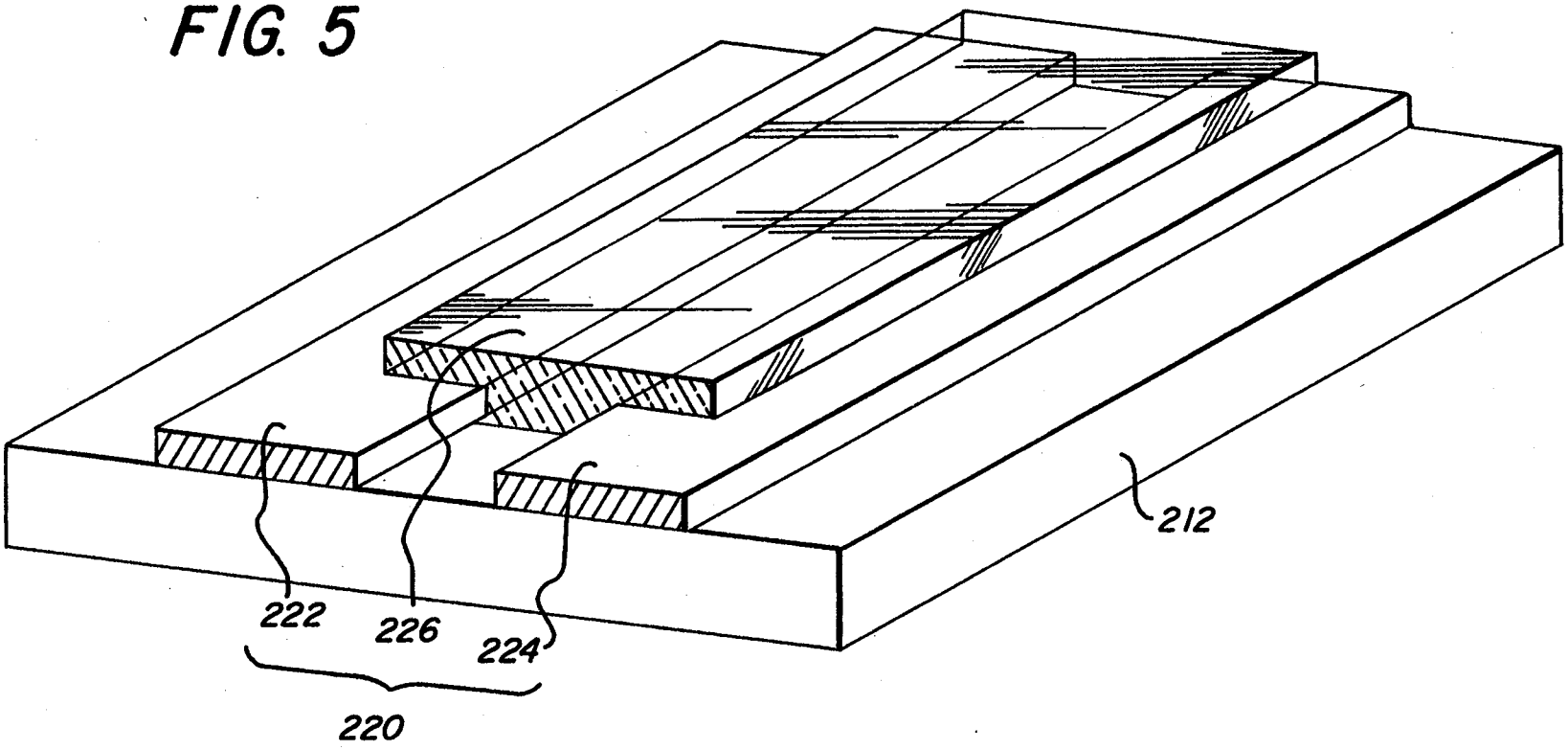

In FIG. 5, a circuit 210 comprises a capacitor 220 which serves as an overlay-responsive portion of the circuit. The capacitor 220 comprises first and second metal electrodes 222 and 224. These electrodes are disposed substantially parallel to each other and spaced apart by a small gap. In the absence of the dielectric layer 226 over these electrodes, the capacitor 220 has a particular capacitance. With the addition of the dielectric layer 226, the capacitance of the capacitor 220 is increased because of the higher dielectric constant of the capacitor's dielectric. The value of this capacitance may be adjusted by selectively removing portions of the dielectric material 226 to change the effective dielectric constant of the capacitor 220.

Figure 6:
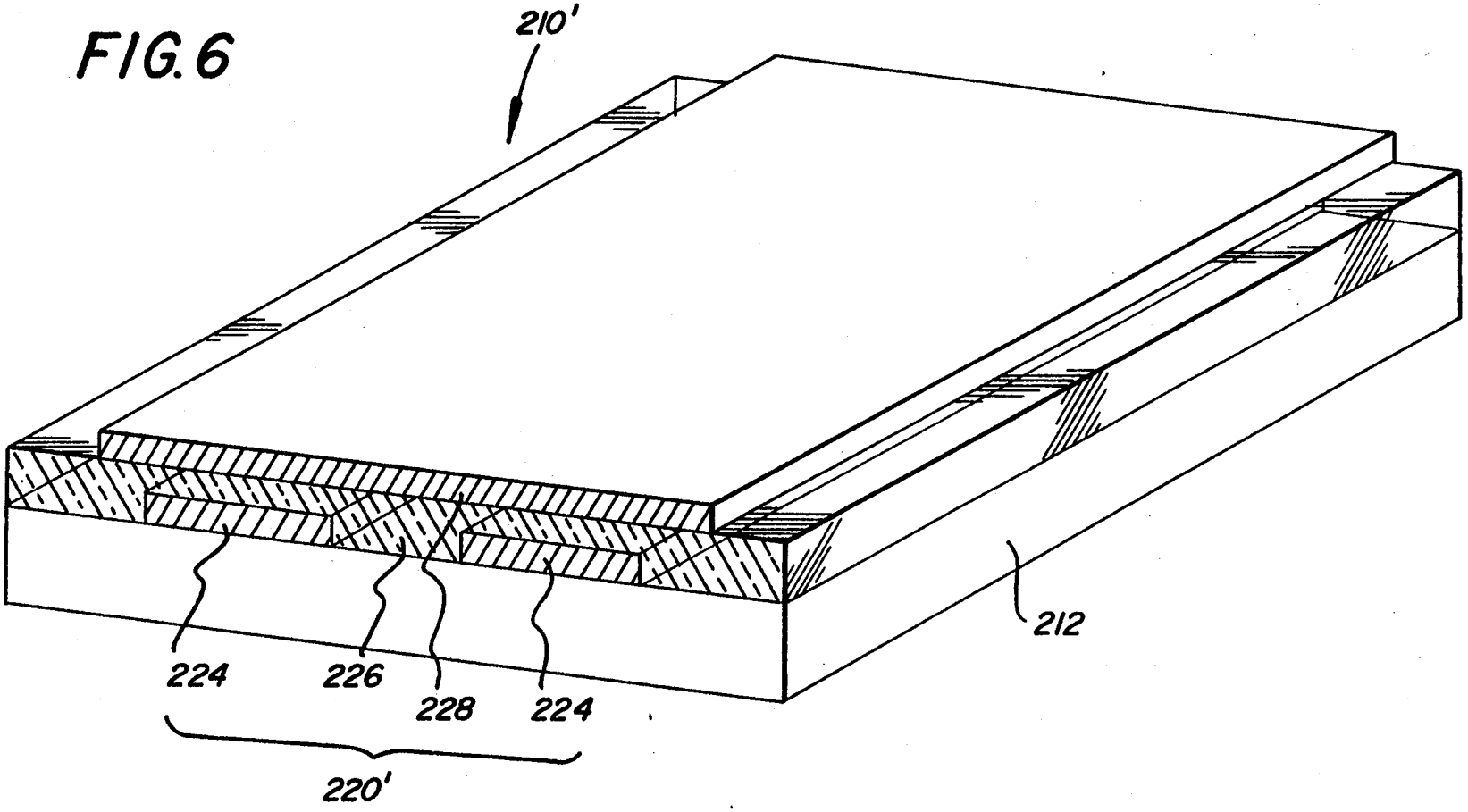

In FIG. 6, an alternative configuration 210' of the circuit 210 is illustrated. In this configuration, a capacitor 220' comprises the electrodes 222 and 224 of the capacitor 220 and the dielectric material 226 of the capacitor 220 but further includes an electrode 228 which overlaps both electrode 222 and 224. The electrode 228 serves as a common electrode of a series connection of two capacitors, the first one being comprised of electrode 222 in combination with dielectric material 226 and electrode 228 and the second one being comprised of electrode 228, dielectric 226 and electrode 224. Also connected in parallel with this series connection of capacitors is the capacitor comprised of electrodes 222 and 224 in combination with the dielectric material 226. The capacitance of this structure may be adjusted by selectively removing portions of the electrode 228 to reduce the size of either or both of the series capacitors by reducing the overlap between the electrode 228 and the electrode 222 or 224. Other structural variations may also be employed.

Figure 7:
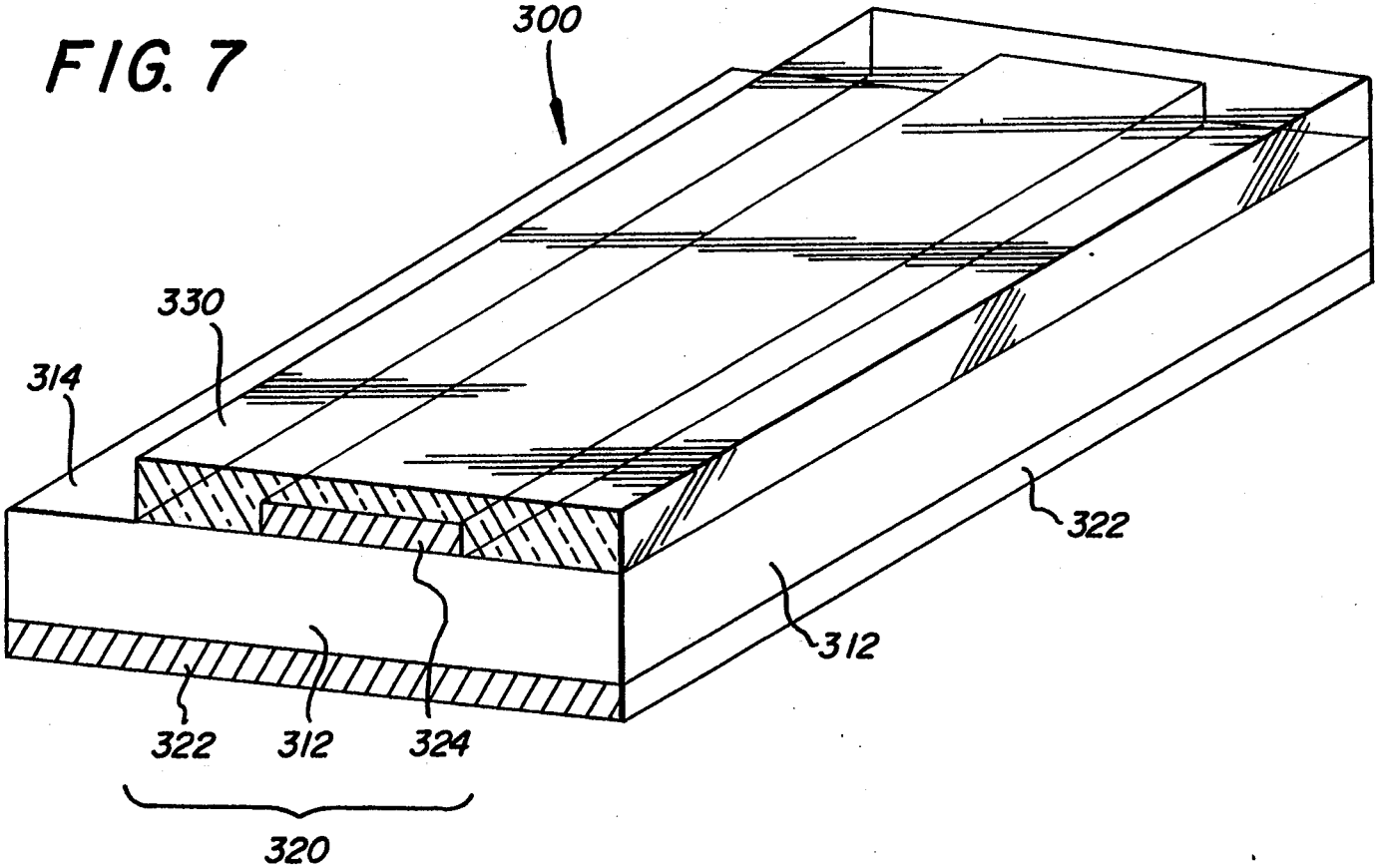

In FIG. 7, a circuit 300 includes a microstrip transmission line 320 comprised of a conductive layer 322 on the lower surface of the body 312 in combination with a signal conductor 324 disposed on the upper surface 314 of the body 312. The impedance of this microstrip transmission line is modified by disposal of the polymer dielectric layer 330 on top of the signal conductor 324 and the adjacent portions of the upper surface 314 of body 312. The presence of the dielectric layer 330 has the effect of making the microstrip transmission line 320 a buried microstrip transmission line thereby reducing the impedance of the transmission line or modifying its propagation constant.

Figure 8:
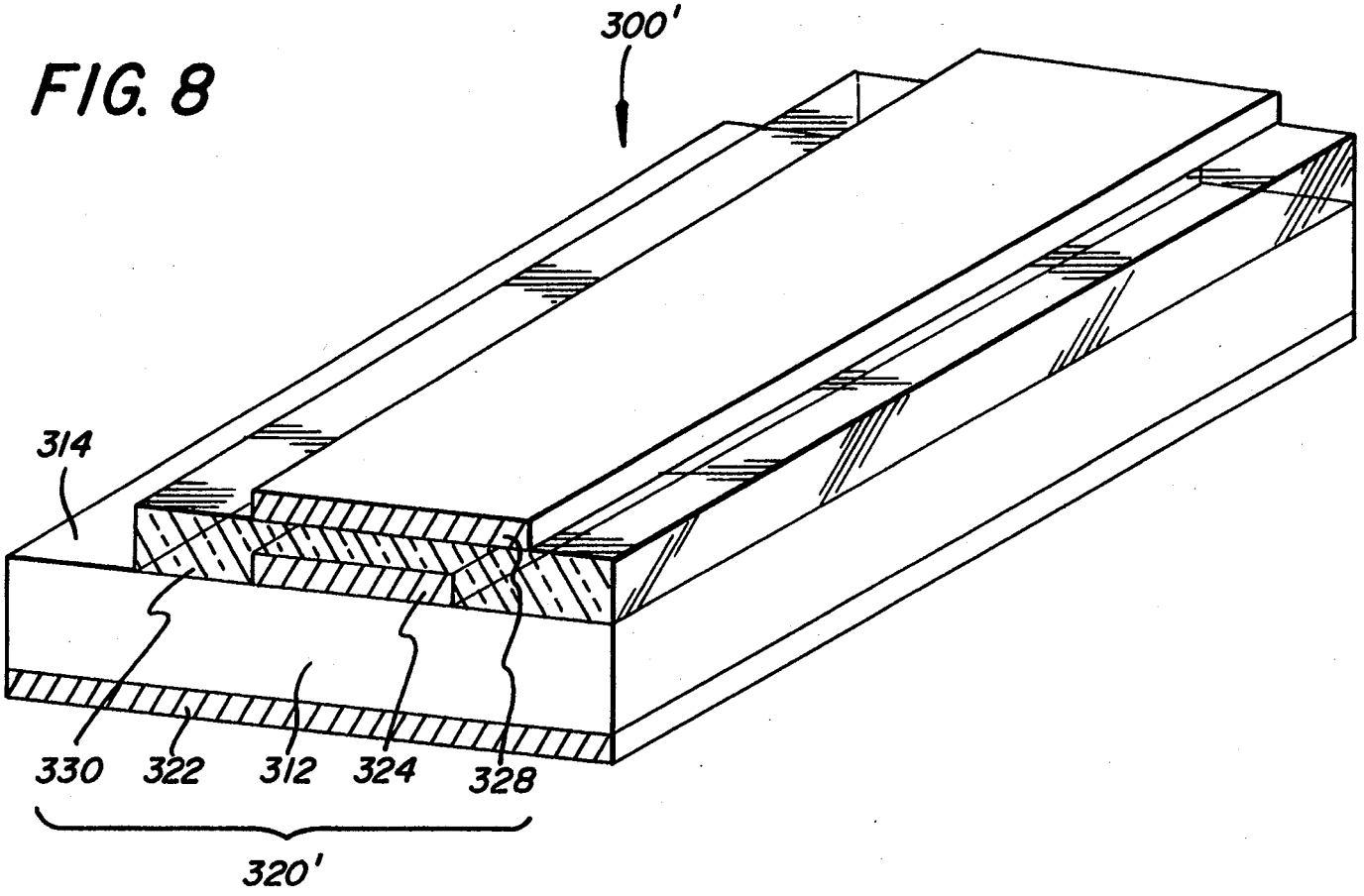

In FIG. 8, a modified version 300' of the circuit 300 of FIG. 7 is illustrated. In this modified version, a transmission line 320' comprises the same components as the transmission line 320 with the addition of an upper electrode 328 which converts the transmission line from a buried microstrip transmission line into a strip line transmission line. In this configuration, the upper conductor 328 would normally be connected to the lower conductor 322. Alternatively, the upper conductor 328 may comprise a second signal conductor whereby the structure 320' becomes a coupler rather than a simple transmission line. In the latter situation, the coupling coefficient can be reduced by trimming the upper conductor 328 to reduce the amount of overlap between conductors 328 and 324.

If the overlying conductor 328 is (1) disposed at an angle to the conductor 324 rather than parallel to it, and (2) the conductor 328 is connected to the signal conductor 324 through a via hole, then the conductor 328, the ground conductor 322 and intervening dielectric comprise a microwave transmission line in their own right. This transmission line may be left open circuited to provide an open circuit transmission line stub. Alternatively, it can be made a short circuited transmission line stub by providing a via connection at the appropriate distance from the conductor 324 to an underlying ground conductor on the upper surface of the body 312. As a further alternative, the conductor 328 may be configured to provide a shunt reactance in parallel with the component or circuit element to which it is connected through a via hole. The conductor 328, by appropriate control of its geometry, may function either as a capacitive shunt reactance or an inductive shunt reactance. A significant advantage of employing such reactive tuning is the fact that it can be connected directly to the component whose characteristics need to be corrected or adjusted. This minimizes undesired or unintentional inductances, capacitances and circuit delays which could adversely affect either circuit gain or circuit bandwidth, or both. In order to provide maximum versatility in the tuning or trimming of the microwave circuit, it should be designed to provide space for the trimming components in which undesired interaction between the trimming components and components other than the trimmed component is minimized.

The configuration of these via hole connections include particular features when the structure is fabricated by first bonding the dielectric layer to the underlying structure, then forming the via holes in the dielectric by laser "drilling" from above and then depositing the metal of the conductors 328 over the dielectric and in the via holes where it makes ohmic contact to an underlying contact pad or other metallization. In particular, the external configuration of the metal in the via hole takes on the shape of the via hole, rather than vice versa as would be the case if the metal were formed first and the dielectric filled in around it. The nature of the laser drilling process, which is used to form the via holes by drilling from the top, typically results in a via hole which is wider at the top than at the bottom. This via hole shape provides improved metal continuity between the portion of a conductor which is disposed at the bottom of a via hole and the portion which is outside the via hole. This is because the via hole wall surface on which the metal is deposited has a sloping-upward-and-outward configuration which is known from the semiconductor arts to result in a deposited metallization layer achieving better step coverage than is achieved where the step has a vertical wall surface. The term step coverage refers to the uniformity of the metal coverage where the deposition surface changes levels from one planar surface area (the bottom of the via hole) to another planar surface area (the top of the dielectric layer). When the conductors are formed in accordance with the preferred manner described in the background Patents and Patent Applications, the upper surface of the metal conductor typically has a depression or dimple in it at the via hole because the metal of the conductors is deposited to a substantially uniform thickness everywhere, including in the via holes (which are not filled prior to deposition of the metal across the planar surface of the dielectric layer). Consequently, the surface topology of the metallization is similar to the surface topology of the layer on which it is deposited.

Figure 9:
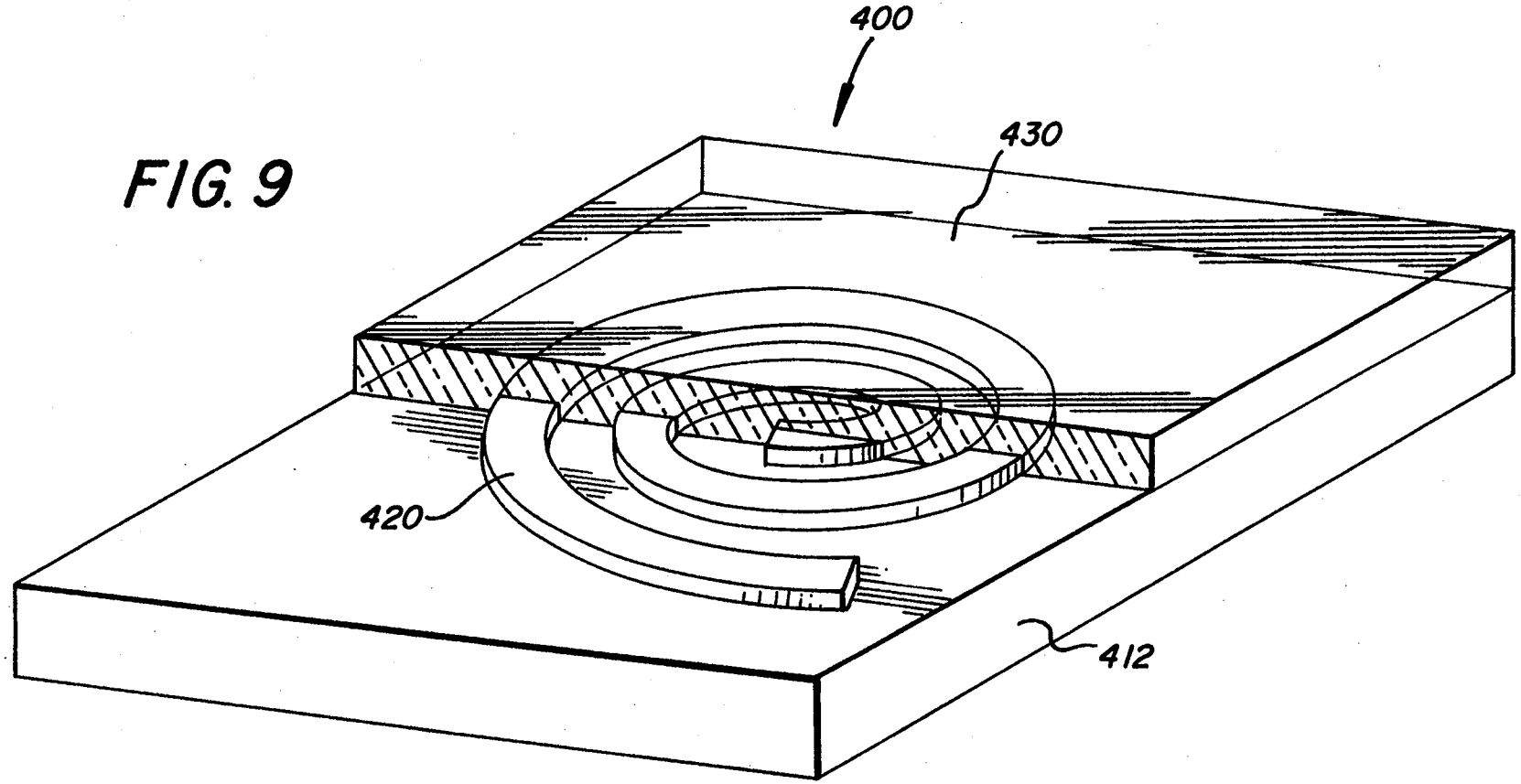

In FIG. 9, a circuit 400 includes an inductor 420 in the form of a planar spiral of conductive material whose ends are connected to internal portions of the structure of the body 412. Alternatively, the ends of this inductor may be connected to external conductors disposed on the dielectric layer 430. As illustrated in FIG. 9, the dielectric layer 430 has been disposed on the entire upper surface of the body 412 and then selectively removed from the front portion of the body in the illustration. The presence of the dielectric layer 430 increases the inter-turn capacitance within inductor 420 because of the dielectric 430's higher dielectric constant as compared to the air or vacuum otherwise present over the spiral conductor. This increased capacitance reduces the impedance of the inductor and reduces its resonant frequency with corresponding effects on the operation of an overall circuit in which it is connected.

The operating characteristics of the structure illustrated in FIG. 9 can be further varied by forming a second inductor on the upper surface of an unpatterned dielectric layer 430 whereby the inductor 420 and the additional inductor are coupled. The degree of coupling can be controlled by the location in which the inductor on top of the dielectric layer 430 is placed.

Alternatively, a material having a permeability other than 1 (that is, a magnetic field modifying material) may be disposed on the upper surface of the (preferably unpatterned) dielectric layer 430 over or in the vicinity of the inductor 420. Where a high permeability material is disposed in this manner, the inductance of the inductor 420 can be increased significantly. Patterning of this high permeability material can be used to adjust the inductance of the inductor 420. Similarly, if the material disposed on top of the dielectric layer 430 has a permeability of less than 1, an opposite effect on the inductance is produced.

With respect to the deposition of a material having a permeability of other than 1 on top of the dielectric layer 430, it should be recognized that the frequency characteristics of that material must be taken in to account since the losses of such high permeability materials vary with frequency as is well known in the art.

Figure 10:
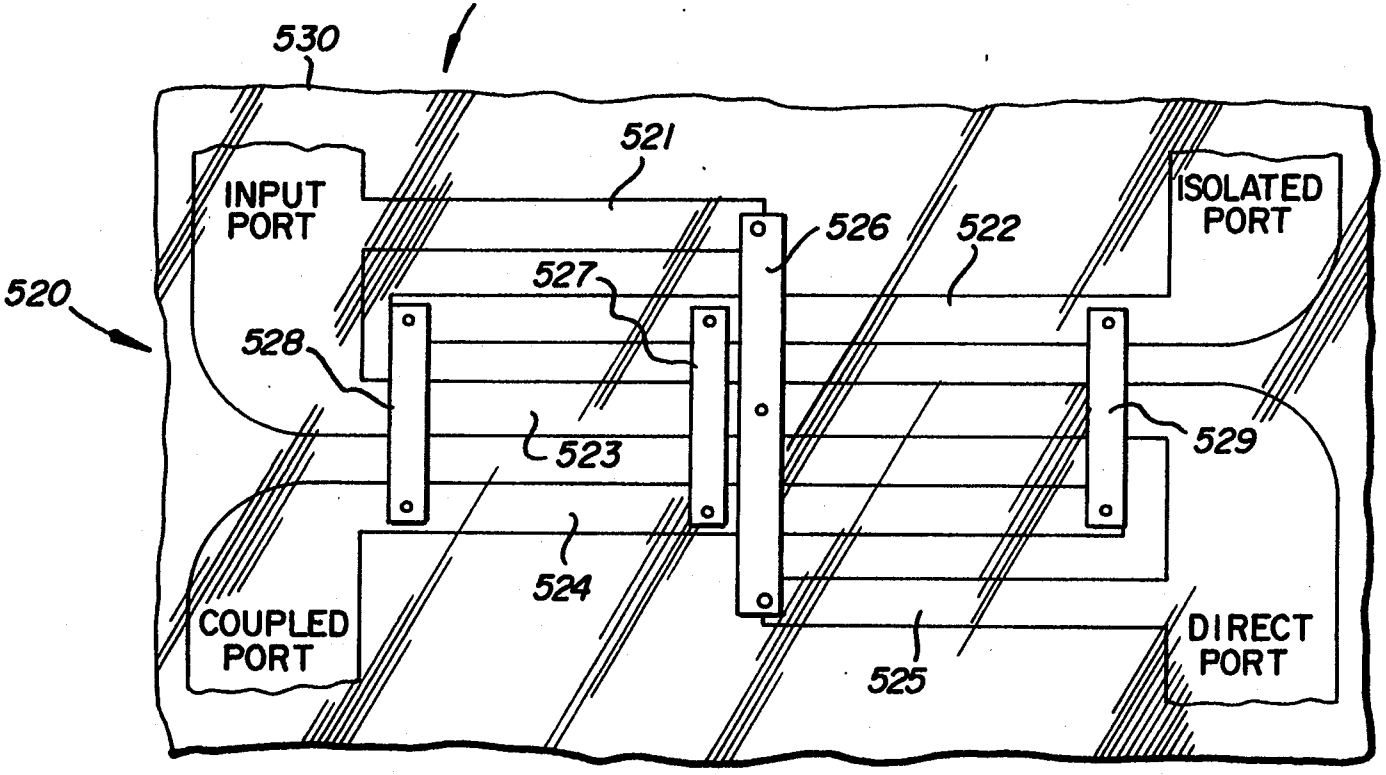

In FIG. 10, a circuit 510 including an interdigitated or Lange coupler 520 is illustrated. The Lange coupler 520 comprises four conductive strips 521–525 with alternate conductive strips connected together at their centers by overlying conductors 526 and 527. The "free" end of conductor 522 is connected to conductor 524 at the coupled port by overlying high density interconnect conductor 528 and the "free" end of conductor 524 is connected to conductor 522 at the isolated port by overlying high density interconnect conductor 529. These overlying conductors are disposed on the dielectric layer 530, which is shown overlying the entire structure except for the conductors 526–529 which are disposed on it. The amount of inter-conductive-strip capacitance affects the operating characteristics of this Lange coupler with the result that the operating characteristics of this coupler may be tailored or adjusted by selectively removing dielectric material 530 from above the conductive strips 521–525. The operation of this coupler is explained in U.S. Pat. No. 4,636,754 to Presser et al.

It will be recognized that many other devices or structures which may be incorporated in the body 12 are overlay-responsive. In the case of monolithic microwave integrated circuits, a particularly sensitive overlay responsive portion of the circuit is the feedback path of the circuit which extends from the output of an active device back to its input since the characteristics of that feedback transmission path directly control the forward transfer function of the active portion of the structure because of the inverse relationship between the transfer function of the feedback path and the overall transfer function which that feedback path imposes on the active device.

While a number of specific overlay responsive structures have been illustrated and described, it will be recognized that there are a vast number of additional overlay responsive structures whose operating characteristics may be adjusted in a straightforward, simple manner in accordance with the present invention.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. In combination:

a body including a microwave component, a first surface of said body including an overlay-responsive portion, said circuit having electrical operating characteristics which are affected by the presence of a dielectric material on said overlay-responsive portion of said surface;

a patterned polymer dielectric material disposed on said first surface of said body, the pattern of said polymer dielectric material including polymer dielectric material present on said overlay-responsive portion of said first surface.

2. The combination recited in claim 1 wherein:

said body comprises a semiconductor chip.

3. The combination recited in claim 1 wherein:

said microwave component comprises an active device.

4. The combination recited in claim 1 wherein:

said overlay responsive portion is associated with a semiconductor chip.

5. The combination recited in claim 1 wherein:

said overlay responsive portion is associated with an active device.

6. The combination recited in claim 1 wherein:

said overlay responsive portion is spaced from any semiconductor chip.

7. The combination recited in claim 1 wherein:

said body includes a plurality of contact pads disposed at said first surface thereof and said pattern leaves said contact pads sufficiently free of said polymer dielectric material for bonding external conductors thereto.

8. The combination recited in claim 1 wherein:

said polymer dielectric material comprises a layer.

9. The combination recited in claim 1 wherein:

said polymer dielectric material comprises a layer of a first polymer dielectric material bonded to said body by a layer of a second polymer dielectric material.

10. The combination recited in claim 1 wherein:

said polymer dielectric material is disposed on only part of said overlay-responsive portion.

11. The combination recited in claim 1 wherein:

said polymer dielectric material is disposed on all of said overlay-responsive portion, but with a depth which causes said operating characteristics to be intermediate those when no polymer dielectric material is present on said overlay-responsive portion and those when a greater depth of said polymer dielectric material is present on said overlay-responsive portion.

12. The combination recited in claim 1 wherein:

said overlay-responsive portion comprises a capacitor electrode.

13. The combination recited in claim 1 wherein:

said overlay-responsive portion comprises an inductor.

14. The combination recited in claim 1 wherein:

said overlay-responsive portion comprises the gate electrode of a field effect device.

15. The combination recited in claim 1 wherein:

said overlay-responsive portion comprises a microstrip transmission line.

16. The combination recited in claim 1 wherein:

said component comprises a monolithic microwave integrated circuit which includes a feedback transmission line; and said overlay-responsive portion comprises said feedback transmission line.

17. The combination recited in claim 1 wherein:

said overlay-responsive portion comprises a signal conductor.

18. The combination recited in claim 17 further comprising:

a conductive material disposed on the exposed surface of said polymer dielectric material, said polymer dielectric material, said conductive material and said signal conductor together forming a transmission line having a configuration selected to control the operating characteristics of said microwave component.

19. The combination recited in claim 1 wherein:

said overlay-responsive portion comprises a microwave coupler.

20. The combination recited in claim 19 wherein:

said microwave coupler is an interdigitated coupler.

21. The combination recited in claim 1 further comprising:

a conductive material disposed on the exposed surface of said polymer dielectric material, said conductive material having a configuration selected to provide said component with operating characteristics which are different than its operating characteristics in the absence of said conductive material.

22. The combination recited in claim 21 wherein:
said conductive material is disposed in ohmic contact with a conductive portion of said body.

23. The combination recited in claim 22 wherein:
said conductive material comprises a feedback conductor connecting two different conductive portions of said body.

24. The combination recited in claim 22 wherein:
said conductive portion of said chip comprises a contact pad.

25. The combination recited in claim 21 wherein:
said overlay-responsive portion comprises a capacitor electrode.

26. The combination recited in claim 21 wherein:
said overlay-responsive portion comprises an inductor.

27. The combination recited in claim 21 wherein:
said overlay-responsive portion comprises the gate electrode of a field effect device.

28. The combination recited in claim 21 wherein:
said overlay-responsive portion comprises a microstrip transmission line.

29. The combination recited in claim 21 wherein:
said component comprises a monolithic microwave integrated circuit which includes a feedback transmission line; and
said overlay-responsive portion comprises said feedback transmission line.

30. The combination recited in claim 21 wherein:
said overlay-responsive portion comprises a signal conductor.

31. The combination recited in claim 21 wherein:
said overlay-responsive portion comprises first and second electrodes;
said conductive material overlies both said first and said second electrodes to form a series connection of first and second capacitors.

32. The combination recited in claim 21 wherein:
said overlay-responsive portion comprises an interdigitated microwave coupler.

33. The combination recited in claim 1 further comprising:
a conductive material disposed on the exposed surface of said polymer dielectric material, said polymer dielectric material and said conductive material having a configuration selected to provide said component with operating characteristics which are different than its operating characteristics in the absence of said conductive material.

34. A microwave circuit comprising:
a body including a microwave component and comprising a microwave signal conductor;
a polymer dielectric material disposed on said first surface of said body;
a patterned conductive material disposed on said dielectric material, said conductive material being ohmically connected to said microwave signal conductor through a via hole in said dielectric material and being patterned to adjust the operating characteristics of microwave circuit.

35. The combination recited in claim 34 wherein:
said conductive material comprises an open circuit transmission line stub.

36. The combination recited in claim 34 wherein:
said conductive material comprises an short circuit transmission line stub.

37. The combination recited in claim 34 wherein:
said conductive material provides shunt capacitance.

38. The combination recited in claim 34 wherein:
said conductive material is configured to provide a tuning shunt reactance.

39. The combination recited in claim 38 wherein:
said tuning reactance is disposed closely adjacent to the portion of the circuit whose characteristics said shunt reactance is configured to tune.

40. The combination recited in claim 39 wherein:
said tuning shunt reactance is a capacitive reactance.

41. The combination recited in claim 39 wherein:
said tuning shunt reactance is an inductive reactance.

42. A microwave circuit comprising:
a body including a microwave component and comprising a microwave signal conductor;
a polymer dielectric material disposed on said first surface of said body;
a patterned magnetic field modifying material disposed on said dielectric material in the vicinity of said signal conductor, said magnetic field modifying material having a permeability other than 1 and being configured to modify the operating characteristics of said microwave circuit.

43. A microwave component comprising:
a semiconductor chip including a microwave device, said chip including contact pads disposed at a first surface thereof;
a polymer dielectric material disposed on said first surface of said chip;
said polymer dielectric material being present on a first portion of said first surface where the presence of said polymer dielectric material modifies the electrical operating characteristics of said microwave component as compared to those operating characteristics if said polymer dielectric material were absent from said first portion of said first surface; and
said polymer dielectric material being absent from a second portion of said first surface where presence of said polymer dielectric material would modify the electrical operating characteristics of said microwave component as compared to those operating characteristics with said polymer dielectric material absent from said second portion of said first surface.

44. In a high density interconnect structure of the type comprising a substrate having an electronic component disposed thereon, said component including contact pads thereon, one or more polymer dielectric material layers disposed thereover and having apertures therein, one or more patterned conductive layers overlying selected ones of said dielectric layers and extending into selected ones of said apertures into ohmic contact with selected contact pads or other conductive layers, the improvement comprising:
a microwave component physically and electrically embedded in said high density interconnect structure;
a portion of the dielectric of said high density interconnect structure disposed on said microwave component and configured to trim an electrical operating characteristic of said microwave component to a desired condition.

45. A method of adjusting the electrical operating characteristics of a microwave component comprising:

disposing a layer of dielectric material on the surface of said component;

selectively removing said dielectric material to leave said dielectric material in selected locations where its presence modifies the electrical operating characteristics of said component as compared to those characteristics in the absence of said dielectric material.

46. The method recited in claim 45 comprising, while performing the step of selectively removing:

operating said component; and monitoring an electrical characteristic of said component.

47. The method recited in claim 45 comprising switching among:

the step of selectively removing; and a step of operating said component and monitoring an electrical characteristic of said component.

48. The method recited in claim 45 comprising alternating between:

the step of selectively removing; and monitoring an electrical characteristic of said component.

49. The method recited in claim 45 wherein the step of selectively removing comprises:

removing said polymer dielectric material in a predetermined pattern determined in accordance with previously obtained electrical test results for said component.

50. The method recited in claim 49 wherein said electrical test results are obtained prior to disposition of said polymer dielectric material on said component.

51. The method recited in claim 49 wherein said electrical test results are obtained after disposition of said polymer dielectric material on said component.

52. The method recited in claim 45 wherein:

said dielectric material comprises a polymer.

53. The method recited in claim 45 further comprising the step of:

selectively depositing a conductive material on said component in a configuration to modify said electrical operating characteristics.

54. The method recited in claim 53 wherein the step of selectively depositing comprises restricting the deposition of said conductive material to being on said polymer dielectric material.

55. A method of adjusting the electrical operating characteristics of a microwave component comprising:

a) disposing a layer of dielectric material on the surface of said component;

b) electrically testing said component;

c) selectively removing said dielectric material to leave said dielectric material in selected locations where its presence modifies the electrical operating characteristics of said component as compared to those characteristics in the absence of said dielectric material;

d) electrically retesting said component;

e) repeating steps (c) and (d) until said operating characteristics exhibit a desired attribute.

56. The method recited in claim 55 further comprising after step (b) and each repetition of step (d) the step of:

comparing the testing-determined electrical operating characteristics of said component with reference electrical operating characteristics.

57. The method recited in claim 55 further comprising the step of:

selectively depositing a conductive material on said component in a configuration to modify said electrical operating characteristics.

58. The method recited in claim 57 wherein the step of selectively depositing comprises:

restricting the deposition of said conductive material to being on said polymer dielectric material.

59. The method recited in claim 57 wherein:

the step of selectively depositing is performed after the step of selectively removing.

60. A method of adjusting the operating characteristics of a microwave component comprising:

providing a polymer dielectric material on a surface of said component;

monitoring an operating characteristic of said component; and selectively removing portions of said polymer dielectric from said microwave component until said operating characteristic exhibits a particular attribute.

61. The method recited in claim 60 wherein the step of selectively removing comprises:

selectively removing portions of said polymer dielectric material while monitoring said operating characteristic; and stopping said selectively removing when said operating characteristic exhibits said particular attribute.

62. The method recited in claim 60 further comprising the step of:

selectively depositing conductive material on said component in a pattern to modify said electrical operating characteristics in a desired manner.

63. A method of adjusting the operating characteristics of a microwave component comprising:

providing a polymer dielectric material on a surface of said component;

electrically testing said component with said polymer dielectric material thereon to determine its electrical operating characteristics;

comparing the testing-determined operating characteristics with established, desired operating characteristics;

determining from said comparison a pattern in which said polymer dielectric material should be removed from said component to bring the electrical operating characteristics of said component closer to said established desired operating characteristics; and selectively removing portions of said polymer dielectric material in accordance with said pattern to provide said component with particular desired operating characteristics.

64. The method recited in claim 63 further comprising the step of:

electrically retesting said component after the step of selectively removing.

65. The method recited in claim 63 further comprising the steps of:

electrically retesting said component after the step of selectively removing; and selectively removing further polymer dielectric material if said electrical operating characteristics of said component differ by more than a tolerance from said particular operating characteristics.

66. The method recited in claim 63 further comprising the step of:

providing a conductive material on said component in a configuration selected to modify said electrical operating characteristics.

67. The method recited in claim 66 wherein the step of providing a conductive material comprises:

restricting the deposition of said conductive material to being on said polymer dielectric material.

68. The method recited in claim 66 wherein the step of providing a conductive material is performed after the step of selectively removing.

69. A method of adjusting the operating characteristics of a microwave component comprising:

electrically testing said component to determine its electrical operating characteristics;

comparing the testing-determined operating characteristics with reference operating characteristics;

providing a polymer dielectric material on a surface of said component in a predetermined configuration;

determining from said comparison a pattern in which polymer dielectric material should be selectively removed from said predetermined configuration to bring the electrical operating characteristics of said component within a tolerance of an established desired set of operating characteristics; and selectively removing portions of said polymer dielectric material in accordance with said pattern to provide said component with electrical operating characteristics which are within said tolerance of established desired set of electrical operating characteristics.

70. The method recited in claim 69 further comprising the step of:

electrically retesting said component after the step of selectively removing.

71. The method recited in claim 69 further comprising the steps of:

electrically retesting said component after the step of selectively removing; and selectively removing further polymer dielectric material if said electrical operating characteristics of said component differ by more than a tolerance from said established desired set of electrical operating characteristics.

72. The method recited in claim 69 further comprising the steps of:

electrically retesting said component after the step of selectively removing;

disposing additional polymer dielectric material on said component if said electrical operating characteristics of said component differ by more than a tolerance from said established desired set of electrical operating characteristics in a direction which makes the presence of additional polymer dielectric material desirable.

73. The method recited in claim 72 further comprising the steps of:

electrically retesting said component after the step of disposing additional polymer dielectric material; and selectively removing more polymer dielectric material if said electrical operating characteristics of said component differ by more than a tolerance from said established desired set of electrical operating characteristics.

74. A method of adjusting the operating characteristics of a microwave component comprising:

providing a polymer dielectric material on a surface of said component;

disposing a conductive material over said polymer dielectric material;

electrically testing said component with said polymer dielectric material and conductive material thereon to determine its electrical operating characteristics;

comparing the testing-determined operating characteristics with established desired operating characteristics;

determining from said comparison a pattern in which said conductive material should be removed from said component to bring the electrical operating characteristics of said component closer to said established desired operating characteristics; and selectively removing portions of said conductive material in accordance with said pattern to provide said component with particular desired operating characteristics.

75. The method recited in claim 74 further comprising the step of:

electrically retesting said component after the step of selectively removing.

76. The method recited in claim 74 further comprising the steps of:

electrically retesting said component after the step of selectively removing; and selectively removing further conductive material if said electrical operating characteristics of said component differ by more than a tolerance from said particular operating characteristics.

77. A method of adjusting the operating characteristics of a microwave component comprising:

electrically testing said component to determine its electrical operating characteristics;

comparing the testing-determined operating characteristics with reference operating characteristics;

providing a polymer dielectric material on a surface of said component in a predetermined dielectric configuration;

disposing a conductive material on an exposed surface of said polymer dielectric material in a predetermined conductive configuration;

determining from said comparison a pattern in which said conductive material should be selectively removed from said predetermined conductive configuration to bring the electrical operating characteristics of said component within a tolerance of an established desired set of operating characteristics; and selectively removing portions of said conductive material in accordance with said pattern to provide said component with electrical operating characteristics which are within said tolerance of an established desired set of electrical operating characteristics.

78. The method recited in claim 77 further comprising the step of:

electrically retesting said component after the step of selectively removing.

79. The method recited in claim 77 further comprising the steps of:

electrically retesting said component after the step of selectively removing; and selectively removing further conductive material if said electrical operating characteristics of said component differ by more than a tolerance from said established desired set of electrical operating characteristics.

80. The method recited in claim 79 further comprising the steps of:

electrically retesting said component after the step of selectively removing; and selectively removing dielectric material if said electrical operating characteristics of said component differ by more than a tolerance from said established desired set of electrical operating characteristics.

81. The method recited in claim 77 further comprising the steps of:

electrically retesting said component after the step of selectively removing;

disposing additional conductive material on said polymer dielectric material on said component if said electrical operating characteristics of said component differ by more than a tolerance from said established desired set of electrical operating characteristics in a direction which makes the presence of additional conductive material desirable.

82. The method recited in claim 81 further comprising the steps of:

electrically retesting said component after the step of disposing additional conductive material; and selectively removing more conductive material if said electrical operating characteristics of said component differ by more than a tolerance from said established desired set of electrical operating characteristics.

* * * * *